United States Patent [19]

Fricke

[11] 4,202,141

[45] May 13, 1980

[54] TWO WAY SPARK PLUG CLEANER AND METHOD

[76] Inventor: Roy A. Fricke, River Forest, Ill.

[21] Appl. No.: 958,711

[22] Filed: Nov. 8, 1978

[51] Int. Cl.[2] ..... B24B 1/00; B24B 3/34

[52] U.S. Cl. ..... 51/412; 51/424; 51/434; 51/319

[58] Field of Search ..... 51/319–321, 51/412, 424, 432, 433, 434; 134/7

[56] References Cited

U.S. PATENT DOCUMENTS

| | | | |
|---|---|---|---|
| 1,690,629 | 11/1928 | Fleming | 51/412 |
| 2,261,185 | 11/1941 | Rosenberger | 51/433 |
| 2,550,168 | 4/1951 | Smid | 241/275 X |
| 2,782,564 | 2/1957 | Liebman | 51/424 |
| 2,789,804 | 4/1957 | Toulmm | 51/434 X |
| 3,567,141 | 3/1971 | Zbraniborski | 241/55 X |
| 4,028,851 | 6/1977 | Fricke | 51/412 |
| 4,165,586 | 8/1979 | Fricke | 51/412 |

FOREIGN PATENT DOCUMENTS

| | | | |
|---|---|---|---|
| 253910 | 2/1912 | Fed. Rep. of Germany | 51/426 |

*Primary Examiner*—Gary L. Smith
*Attorney, Agent, or Firm*—Alter and Weiss

[57] ABSTRACT

The present disclosure relates to a spark plug cleaner and a method of operating the cleaner. The spark plug cleaner includes a closed container adapted to receive and hold a spark plug in a horizontal position with its electrode inside the closed container. A motor driven multi-directional rotatable impeller, having a vertical shaft extending through the top wall of the container, is mounted within the container with the multi-directional rotatable impeller having an axial inlet facing downwardly inside the container. The container is provided with a horizontally extended duct between the lower end of the spark plug holder and the downwardly open inlet of the multi-directional rotatable impeller to permit the impeller to project the particulate against the spark plug and to continuously recirculate the particulate through the multi-directional rotatable impeller during operation.

11 Claims, 5 Drawing Figures

TWO WAY SPARK PLUG CLEANER AND METHOD

BACKGROUND OF THE INVENTION

In the past, several devices have been suggested for cleaning spark plugs mounted in an enclosed housing. One suggestion has contemplated the use of a blower, mounted within the housing and surrounded with shroud or scroll cage which is attached to an enclosed hopper within the housing. When the blower is turned on, the particulate collected by the hopper are directed in a particulate stream against the exposed end of the spark plug. When the amount of particulate within the hopper has been consumed, it is necessary to rotate the device to again deposite the abrasive particulate into the hopper, so that the cleaner can perform its intended function. Because the shroud or scroll cage surrounding the blower necessarily requires a space between the blower and shroud, the efficiency of the blower is severely restricted because of the amount of particulate circulating between the blower and the shroud do not exit from the opening in the shroud. Thus, such devices are relatively inefficient and have not experienced wide commercial acceptance.

In still another device similar to the one described above, a blower, surrounded with a shroud or scroll cage, includes a tubular member extending from the center of the blower downwardly into a corner or bottom of the enclosed housing, such that when the blower is operating, it sucks up particulate through the tube into the blower so that a stream of abrasive particulate may be directed towards the spark plug. Again, because the shroud or scroll cage surrounding the blower permits the abrasive particles to freely rotate around the blower, the efficiency of such blowers has been greatly restricted.

SUMMARY OF THE INVENTION

It is an object of the present invention to provide a small, efficient motor driven spark plug cleaner, which will operate to perform its spark plug cleaning operation when the multi-directional rotatable impeller is driven in either direction of rotation.

It is another object of the present invention to provide a small spark plug cleaner, wherein the projection of a stream of abrasive particulate against the electrode insulator of a spark plug is carried on at a high velocity of impingement by the particulate against the surface to be cleaned, with simultaneous re-circulating of the particulate under a sub-floor through passageways that correspond to the direction of rotation of the impeller.

It is a further object of the present invention to provide a motor driven spark plug cleaner which performs its cleaning function when the impeller is driven in either direction of rotation.

The present invention is directed to a small compact and efficient cleaner designed for cleaning a single spark plug at a time and with a method of performing this cleaning operation. The spark plug cleaner includes a closed container or housing having a sidewall fitted with an elastic spark plug holder adapted to receive and hold a spark plug in a horizontal position with its electrodes exposed inside the container or housing. Superimposed upon the impeller chamber is a motor chamber with a motor mounted in the motor chamber, having a drive shaft extending into the impeller chamber. A multi-directional rotatable impeller is mounted in the impeller chamber on the drive shaft and has an axially disposed inlet port opening downwardly therefrom. A substantially horizontal flow control plate is mounted in the lower part of the impeller chamber directly below the impeller with the flow control plate being supported in the impeller chamber above the floor of the impeller chamber. The flow control plate provides a return passageway for particulate discharged by the multi-directional rotatable impeller against the spark plug electrode during operation of the spark plug. The elastic spark plug holder, mounted in the wall of the impeller chamber, is in register with the discharge of abrasive particulate by the impeller which is rotated by the motor. Guide walls are provided which extend from adjacent the elastic spark holder to the downwardly facing inlet opening of the impeller for guiding the particulate discharged against the spark plug holder and electrodes of a spark plug when the impeller is driven by rotation of the motor in either direction.

The advantage of a single spark plug cleaner is primarily that the plugs may be given individual attention without the possible confusion occurring in the case of a multiple plug cleaner, confusion as to which cylinder a specific spark plug belongs or in determining whether a faulty operation is chargeable to spark plug or to cylinder in which it is operated unsatisfactorily. Importantly, the present spark plug cleaner will operate on battery current in either direction and no attention to polarity need be given in making the connection to a battery.

Thus, the present invention relates to a compact, efficient motor driven spark plug cleaner that provides higher abrading qualities than existing prior art devices by removing the commonly used shroud or scroll cage from the blower and utilizing a multi-directional impeller which permits the particulate to escape through the impeller vanes in a 360° pattern. This structure virtually minimizes and eliminates the bounce-back of the particulate into the perimeter of the impeller. Such bounce-back in the prior art devices causes interference with escaping particulate thereby increasing current requirements and unnecessary wear on the extremities of the impeller vanes and results in an overall drop in efficiency of the device.

In operating the present invention, the successive motions of the abrasive particulate material and the carrying air which may be characterized as follows. The first motion imparted to the particulate is caused by the rotating multi-directional impeller driving the particulate against the exposed spark plug terminals where the initial horizontal motion of the particulate ceases. Thereupon gravity draws the particulate into the floor or base of the lower impeller housing. This action of gravity is aided by the air current set in motion by rotation of the impeller. Then, baffle means and side walls predeterminely determine the flow of the particulate along the floor until the particulate arrives in vertical register with the intake of impeller and the particulate is raised in a flow of air into the intake opening and into the eye of the impeller, wherein the vanes of the impeller take charge and repeat the cleaning cycle continuously as long as the motor is in operation.

DETAILED DESCRIPTION

Figure 1:
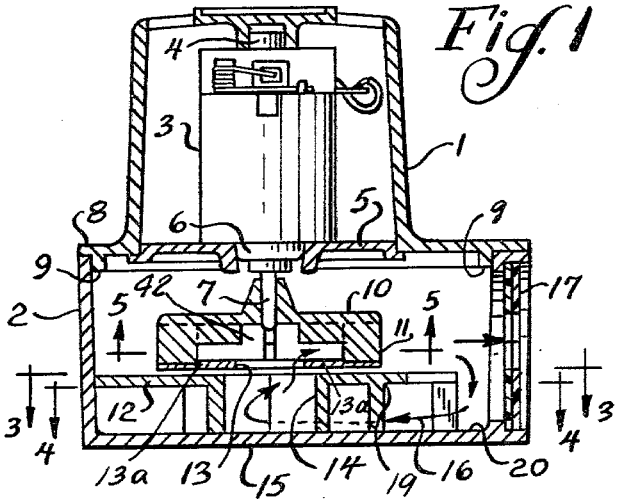
FIG. 1 is a vertical axial section of the present invention taken on the line 1—1 of FIG. 2 looking in the direction of the arrows in FIG. 2.
Figure 2:
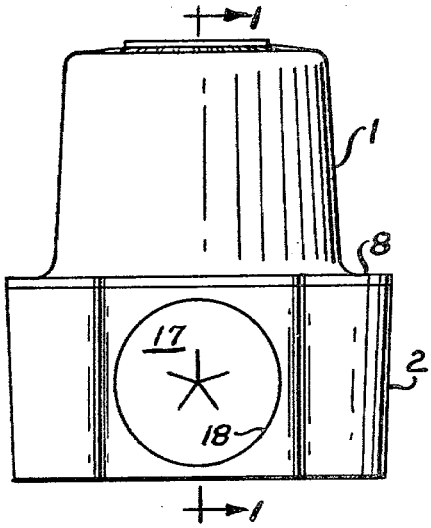
FIG. 2 is a front elevational view of the present invention in accordance with FIG. 1.

Referring now to the drawings, wherein like reference numerals have been used throughout the several views to identify the same or similar parts, in FIGS. 1–5, there is shown a spark plug cleaner in accordance with the present invention. The spark plug cleaner includes a container or housing comprised of an upper cylindrical or cupped-shaped motor housing 1 having a motor 3 suspended therein by hub 4. Preferably, the upper cylindrical motor housing 1 is open at the top for ventilation of the motor. The upper-cupped shaped motor housing 1 is closed at the bottom thereof by a circular plate or member 5, having an opening therein which is adapted to sealingly mount the end 6 of the motor 3 within the cupped-shaped motor housing 1. The circular plate 5 closes the cupped-shaped motor housing 1 where the cupped-shaped motor housing joins the horizontal plate 8, which has a downwardly extending short flange 9 adjacent its periphery. The flange 9 extends into contact with the upper margins of the lower cylindrical or cupped-shaped impeller housing or base 2 and is frictionally connected by extension of the circumferential flange 9 fitting inside the open top of the lower cupped-shaped impeller base 2. The motor mounting circular plate 5, for closing the lower end of the upper cupped-shaped motor housing 1, may be held either frictionally or by a screw thread to the upper cupped-shaped motor housing 1. It has been found that there is very little need for servicing of the motor during usage of the present invention, but that any servicing can be readily accomplished by releasing the circular plate 5 from the upper motor housing 1.

Figure 3:
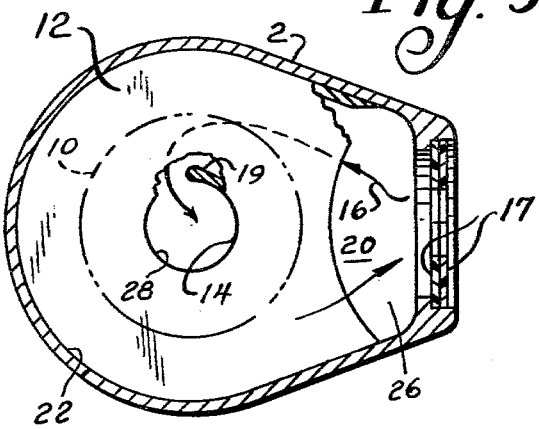
FIG. 3 is a horizontal cross section taken on the line 3—3 of FIG. 1.
Figure 4:
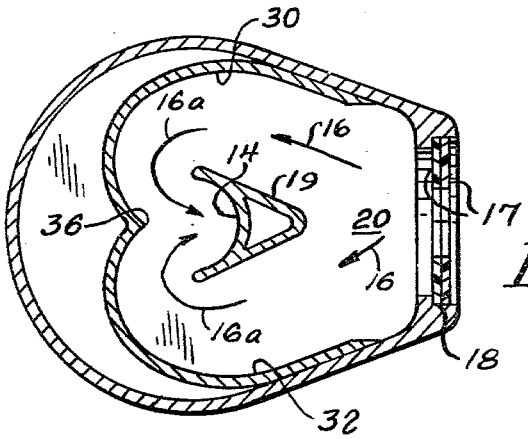
FIG. 4 is a horizontal section taken on the line 4—4 of FIG. 1, showing by indicating arrows the direction of the flow of the particulate when it is air-borne during operation of the present invention.

The hollow cupped-shaped impeller housing 2 is cylindrical throughout approximately two-thirds of its perimeter, as may be seen in FIGS. 3 and 4. The hollow cupped-shaped impeller housing 2 has an open top into which flange 9 of the upper cupped-shaped motor housing 1 is seated and is normally closed off completely to retain a charge of particulate therein. Although the particulate has not been shown in the drawings, it is utilized in the operation of the present invention and silicon carbide may be utilized as a suitable particulate.

As shown in FIGS. 1 and 3, a horizontal plate 12 is positioned within the lower impeller housing 2 and defines the top of the second level of separation and comprises a fixed horizontal wall attached to the inside wall 22 of the impeller housing 2. The wall 22 has an arcuate edge 26 spaced from the entry port 18. The horizontal plate 12 has two vertical openings, namely a central opening 28 which is joined along its edges by a depending baffle wall or bulkhead 14, defining on its concave side the semi-cylindrical wall 14 (FIG. 4). Bulkhead 14 forms a directing surface of the lower impeller housing 2 for guiding the return of air and particulate which has been discharged by the impeller 10 after the particulate has fallen by gravity after encountering the terminals of a spark plug held by the elastic split diaphram 17 in entry port 18 (see FIG. 2). The second opening is defined by the arcuate edge 26 of the horizontal plate 12 that is spaced from entry port 18 and diaphragm 17 that is mounted in the side wall of the lower impeller housing 2. The second defined opening provides access to a flow baffle directing means which provides a return route for the particulate into the eye of the impeller, as will hereinafter be described. The diaphram 17 receives the threaded end of a spark plug and operates as a spark plug holder, thereby exposing the terminals of the spark plug in register with the multi-directional semi-enclosed impeller 10, which is mounted onto motor shaft 7 extending downwardly from the upper cupped-shaped motor housing 1. The impeller includes a lower wall or bottom plate **13*a* having a central opening 13 therein in register with central opening 28 in horizontal plate 12. The impeller includes also a plurality of vanes 11 (FIG. 5) extending upwardly from bottom plate 13 around the periphery thereof. When the motor and the impeller are rotating at high speed, the discharge of particulate by the impeller 10 impinges directly upon the spark plug held in the split holder diaphram 17**.

Figure 5:
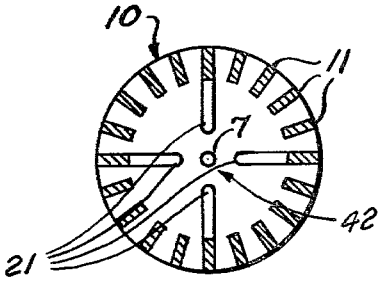
FIG. 5 is a horizontal section taken through the impeller on the line 5—5 of FIG. 1.

The flow directing baffle means 19 cooperates with inwardly curved walls 30 and 32, which extend from the ends of the arcuate ends 26 to a point vertical edge 36 substantially opposite the space from the center of the opening 28. These walls and baffle means 19 funnel the returning air flow and particulate to and against the bulkhead 14 for farther travel into the eye of the impeller. As shown by reference to FIGS. 3 and 4, when the multi-directional impeller 10 is rotated in a counter-clockwise direction, the air flow created by the high speed rotation of the impeller 10 draws or sucks up air from in front of the bulkhead 14 through the central opening 13 in the bottom plate **13*a* into the eye 42 of the impeller 10 from where it is accelerated and discharged radially outwardly against the exposed end of a mounted spark plug. The discharge of air and particulate in the counter-clockwise direction creates a violent circulation of air and particulate by tangential discharge of the air and the particulate through the multidirectional impeller 10. As shown in FIGS. 1 and 5, the impeller 10 is comprised of a plurality of impeller vanes 11 attached to the bottom plate 13*a* and extending upwardly to the top of the impeller 10**.

As previously discussed, the impeller 10 includes a plurality of low profile vanes 21 (FIG. 5), starting at the eye 42 of the impeller and extending outwardly toward the vanes 11. When the impeller 10 is rotating, the low profile vanes 21 accelerate the particulate from the point where it enters the eye 42 of the impeller 10 to a surface velocity that is compatible to enter the discharge vanes 11, thereby reducing the initial shock of the particulate entering the vanes 11. This minimizes wear on the internal portion of vanes 11 thereby increasing the efficiency and prolonging the life of the impeller 10.

During operation of the spark plug cleaner, the particulate, positioned in the bottom interior wall 20 of the lower impeller housing 2, is drawn into the impeller and thrown tangentially outwardly in a counter-clockwise direction upon the rotation of the impeller 10. The discharge of particulate by the impeller 10 is tangential and horizontal and by its motion axially of the spark plug engages the terminal of the spark plug to be cleaned and then drops to the floor or interior wall 20 of the impeller housing 2. The flow of the particulate then continues, as shown by arrow 16 in FIGS. 1 and 3, through and including the arrows 16a in FIG. 4 to the bulkhead 14 of baffle means 19. When the particulate has returned to the bulkhead 14, the suction of the rotating impeller 10 draws the current of air and particulate through the central intake opening 13 of the bottom plate 13a into the eye 42 where the mixed air and particulate are again subjected to the throwing and discharge effect of the impeller 10 to again strike the spark plug terminal and then drop to the floor 20, where it is again swept up by the current flow of the air and particulate, to continue the cycle of cleaning, as desired. The present invention contemplates that the impeller 10 be operated at a relatively high speed and, preferably, with an impeller having a diameter of approximately 1½ inches, the impeller is rotated at approximately 26,000 RPM.

During the operation of the cleaner in accordance with the present invention, there are four successive motions of the abrasive particulate material and the carrying air which may be characterized as follows. The first motion imparted to the particulate is caused by the rotating multi-directional impeller 10 driving the particulate against the exposed spark plug terminals (not shown) where the initial horizontal motion ceases. Thereupon gravity draws the particulate into the floor or base 20 of the lower impeller housing 2. This action of gravity is aided by the air current set in motion by rotation of the impeller 10. Then by baffle means 19 and side walls 30 and 32, the flow of the particulate along the floor 20 described by arrows 16 and 16a arrives in vertical register with the intake 13 of impeller 10 and the particulate is raised in a flow of air into the intake opening and into the eye of the impeller, wherein the vanes 11 of the impeller take charge and repeat the cycle continuously as long as the motor is in operation.

A unique feature of the present invention is that the multi-directional rotatable impeller 10 operates in a horizontal plane, insofar as imparting energy to the particulate is concerned, but the path of the particulate does not altogether remain in a horizontal plane. The part of the path which is in a horizontal plane is that which is directed tangentially from the impeller vanes 11 to the central region of the spark plug terminals held in the elastic holder 17. The second part of the circuit or path by which the particulate travel is that after impinging upon the spark plug the particulate is stopped and dropped to the base or floor 20 of the impeller housing 2. At this point, the particulate is subjected to suction and travels in the return path underneath the horizontal plate 12 to the opening 13 where the particulate is drawn into the eye of the impeller and where it is again taken up by the vanes 11 and projected outwardly against the exposed spark plug. This operation is continued until cleaning is completed.

Although the drawings show only the utilization of a single holder 17 for mounting a single spark plug, it has been determined that if the upper motor housing 1 and lower impeller housing 2 are made somewhat larger, it is possible to provide space for an additional holder 17 mounted in register with the impeller for a second spark plug. Thus, the scope and intent of this disclosure is to encompass a spark plug cleaner for cleaning more than one spark plug simultaneously.

I claim:

1. A spark plug cleaner including in combination, a closed hollow housing comprising a lower impeller housing and an upper motor housing, each of said housings having interfitting margins whereby said housings may be held frictionally and closely fitting relation to provide a closed but separable hollow housing, a drive means mounted in said upper motor housing and having a vertical drive shaft extending downwardly into said lower impeller housing, a multi-directional impeller mounted in said lower impeller housing and operatively connected to said vertical drive shaft, said impeller having an axial inlet opening downwardly therefrom and a plurality of vanes about the periphery thereof, elastic spark plug holder means mounted in the side wall of said lower impeller housing, said spark plug holder means adapted to receive and hold a spark plug in a horizontal position and in register with respect to the outer periphery of said impeller, and flow directing baffle means positioned between said impeller and the base of said lower impeller housing, such that upon the rotation of said multi-directional impeller by said drive means particulate is discharged radially outwardly against said mounted spark plug and said baffle means provides a path for predeterminely guiding the flow of air and spent particulate discharged by said impeller towards said axial inlet opening of said multi-directional impeller and into the eye of said rotating impeller for subsequent discharging of the flow of air and particulate by said impeller against the spark plug until the cleaning operation is completed.

2. The spark plug cleaner in accordance with claim 1 wherein said multi-directional impeller is comprised of an upper impeller back plate and a lower impeller face plate, said lower face plate having a central axial inlet opening therein, with said impeller having a plurality of impeller vanes positioned between said back plate and said face plate around the periphery thereof.

3. The spark plug cleaner in accordance with claim 2 wherein said multi-directional impeller further includes a plurality of low profile vanes extending from the center of said impeller outwardly to said impeller vanes.

4. The spark plug cleaner in accordance with claim 1 wherein said flow directing baffle means includes a concave bulkhead member in register with said axial inlet opening in the bottom of said impeller for guiding the flow of air and spent particulate into the eye of said rotating impeller for subsequent discharging therefrom.

5. A spark plug cleaner including the combination, a closed impeller housing having a side wall and a bottom wall, a multi-directional impeller mounted in said impeller housing and operatively connected by a vertical drive shaft to a drive source, said impeller having an axial inlet opening downwardly therefrom and a plurality of vanes about the periphery thereof, elastic spark plug holder means mounted in said side wall of said impeller housing, said spark plug holder means adapted to receive and hold at least one spark plug in a horizontal position and in register with respect to the outer periphery of said impeller, and a flow directing baffle means positioned between said impeller and the base of said impeller housing, such that upon the rotation of said multi-directional impeller, said particulate is discharged radially outwardly against at least one of said mounted spark plugs and said baffle means provides a path for predeterminely guiding the flow of air and spent particulate discharged by said impeller towards said axial inlet opening of said impeller for subsequent discharging of air and particulate by said impeller against at least one of said spark plugs until the cleaning operation is completed.

6. The spark plug cleaner in accordance with claim 5 wherein said multi-directional impeller is comprised of an upper impeller back plate and a lower impeller face plate, said lower face plate having a central axial inlet opening therein with said impeller having a plurality of impeller vanes positioned between said back plate and said face plate around the periphery thereof.

7. The spark plug cleaner in accordance with claim 6 wherein said multi-directional impeller further includes a plurality of low profile vanes extending from the center of said impeller outwardly to said impeller vanes.

8. The spark plug cleaner in accordance with claim 5 wherein said flow directing baffle means includes a concave bulkhead member in register with said axial inlet opening in the bottom of said impeller for guiding the flow of air and spent particulate into the eye of said rotating impeller for subsequent discharging therefrom.

9. A spark plug cleaner comprising a hollow body which includes in combination an impeller chamber and a superposed motor chamber, a motor in the motor chamber having a drive shaft extending into the impeller chamber, an impeller in the impeller chamber mounted on the drive shaft and having an axially disposed inlet port opening downwardly, a substantially horizontal flow control plate mounted in the lower part of the impeller chamber below the impeller, said flow control plate being supported in the impeller chamber above the floor of said impeller chamber and providing a return passageway for particulate discharged tangentially by said impeller, and an elastic spark plug holder mounted in the wall of said impeller chamber in register with the discharge of abrasive particulate by the impeller which is rotated by the motor, and guiding walls extending from adjacent the elastic spark plug holder to the downwardly facing inlet opening of the impeller for guiding particulate discharged against the spark plug holder and the electrodes of a spark plug mounted in said holder, when the impeller is driven by rotation of the motor in either direction.

10. A method of continuously cleaning a fouled spark plug, including the steps of:

mounting a fouled spark plug in an impeller housing in register with a rotatable multi-directional impeller mounted within said impeller casing containing particulate therein, rotating said impeller within said casing, discharging the resulting flow of air and particulate radially outwardly from said impeller and against the mounted spark plug to clean said plug, and recirculating said flow of air and spent particulate into the eye of the rotating impeller for subsequent discharging the flow of air and particulate against said plug until the cleaning operation is completed.

11. The method of continuously cleaning in accordance with claim 10 wherein said recirculating step includes the steps of dropping the spent particulate from the mounted spark plug to the base of the housing and moving the spent particulate along the base of the housing into the eye of the rotating impeller for subsequent discharging the flow of air and particulate against the plug until the cleaning operation is completed.

* * * * *